US010923058B2

(12) United States Patent
Liao et al.

(10) Patent No.: US 10,923,058 B2
(45) Date of Patent: Feb. 16, 2021

(54) PIXEL DRIVING CIRCUIT, DISPLAY PANEL, AND DISPLAY DEVICE

(71) Applicant: Wuhan China Star Optoelectronics Technology Co., Ltd., Wuhan (CN)

(72) Inventors: Zuomin Liao, Wuhan (CN); Dian Zhang, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 0 days.

(21) Appl. No.: 16/603,241

(22) PCT Filed: Nov. 26, 2018

(86) PCT No.: PCT/CN2018/117389

§ 371 (c)(1),
(2) Date: Oct. 7, 2019

(87) PCT Pub. No.: WO2020/042396

PCT Pub. Date: Mar. 5, 2020

(65) Prior Publication Data

US 2020/0243030 A1 Jul. 30, 2020

(51) Int. Cl.
*G09G 3/36* (2006.01)

(52) U.S. Cl.
CPC ..... *G09G 3/3648* (2013.01); *G09G 3/3674* (2013.01); *G09G 2310/08* (2013.01)

(58) Field of Classification Search
CPC .. G09G 3/3648; G09G 3/3674; G09G 3/3655; G09G 3/36; G09G 3/3696; G09G 3/3677; G09G 3/3614; G09G 3/3233; G09G 3/3659; G09G 3/3688; G09G 2300/0852; G09G 2300/0814; G09G 2310/08; G09G 2320/0247
See application file for complete search history.

(56) References Cited

U.S. PATENT DOCUMENTS

2004/0196278 A1* 10/2004 Kida ..... G09G 3/3648 345/211
2008/0001876 A1* 1/2008 Ito ..... G09G 3/3655 345/87
2008/0094386 A1* 4/2008 Park ..... G02F 1/13306 345/212
2008/0231569 A1* 9/2008 Yamazaki ..... G09G 3/3655 345/84
2011/0310135 A1* 12/2011 Feng ..... G09G 3/3648 345/690
2012/0274618 A1* 11/2012 Chen ..... G06F 3/038 345/208
2015/0286102 A1* 10/2015 Lo ..... G02F 1/133514 349/38

(Continued)

*Primary Examiner* — Ryan A Lubit

(57) ABSTRACT

The present invention provides a pixel driving circuit, a display panel, and a display device. The pixel driving circuit includes: an upper plate of a liquid crystal capacitor and an upper plate of a storage capacitor both connected to a drain of a driving thin film transistor, and a lower plate of the liquid crystal capacitor and a lower plate of the storage capacitor both connected to a voltage regulator module. When the display panel is powered off, the voltage regulator module keeps a voltage difference between the upper and lower plates of the liquid crystal capacitor and the upper and lower plates of the storage capacitor constant.

20 Claims, 2 Drawing Sheets

(56) References Cited

U.S. PATENT DOCUMENTS

| | | | | |
|---|---|---|---|---|
| 2016/0118001 | A1* | 4/2016 | Ahn | G09G 3/3648<br>345/690 |
| 2018/0090079 | A1* | 3/2018 | Jang | G09G 3/3688 |
| 2019/0325839 | A1* | 10/2019 | Chen | G09G 3/3648 |

* cited by examiner

PIXEL DRIVING CIRCUIT, DISPLAY PANEL, AND DISPLAY DEVICE

RELATED APPLICATIONS

This application is a National Phase of PCT Patent Application No. PCT/CN2018/117389 having International filing date of Nov. 26, 2018, which claims the benefit of priority of Chinese Patent Application No. 201811013693.2 filed on Aug. 31, 2018. The contents of the above applications are all incorporated by reference as if fully set forth herein in their entirety.

FIELD AND BACKGROUND OF THE INVENTION

The present invention relates to the field of display technologies, and in particular, to a pixel driving circuit, a display panel, and a display device.

Low temperature poly-silicon (LTPS) and thin film transistor liquid crystal displays (TFT LCDs) are widely used in the display field. In the process of manufacturing LTPS and TFT LCDs, a light-on test is usually used in the cell test (CT) to detect problems that arise during the manufacturing process. However, due to feedthrough, products that are not in-cell (without touch function in the panel) are prone to having ion residue, which causes the pixel voltage to drift during the light-on test, and as a result, the panel cannot be effectively tested.

As shown in FIG. 1, a conventional pixel driving circuit includes a driving thin film transistor T1, a liquid crystal capacitor C1, and a storage capacitor C2. The gate of the driving thin film transistor T1 is connected to a scan line 12, and the scan line 12 is input with a scan signal. The source of the driving thin film transistor T1 is connected to a data line 11, and the data line 11 is input with the access data signal.

The upper plate of the liquid crystal capacitor C1 and the upper plate of the storage capacitor C2 are both connected to a drain of the driving thin film transistor T1, and the lower plate of the liquid crystal capacitor C1 and the lower plate of the storage capacitor C2 are both connected to a common voltage COM.

An existing solution is to reduce the ion residue by turning power off. However, the falling of the scanning signal during the power-off tends to induce a feedthrough phenomenon on the upper plate of the capacitor, causing the pixel voltage to shift, such as from 5V down to 4.8 V, which results in a splash screen when the display panel is turned back on after power off, thereby reducing display effect.

Therefore, it is necessary to provide a pixel driving circuit, a display panel, and a display device to solve the problems of the existing art.

SUMMARY OF THE INVENTION

An object of the present invention is to provide a pixel driving circuit, a display panel, and a display device, to prevent a display panel from the occurrence of a splash screen when the display panel is turned back on after power off, thereby improving the display effect.

To solve the above technical problem, the present invention provides a pixel driving circuit, including: a driving thin film transistor; a liquid crystal capacitor; a storage capacitor; and a voltage regulator module, wherein a gate of the driving thin film transistor is connected to a scan signal, a source of the driving thin film transistor is connected to a data signal, and an upper plate of the liquid crystal capacitor and an upper plate of the storage capacitor are both connected to a drain of the driving thin film transistor, while a lower plate of the liquid crystal capacitor and a lower plate of the storage capacitor are both connected to the voltage regulator module, wherein the voltage regulator module is configured to keep a voltage difference between the upper and lower plates of the liquid crystal capacitor constant and keep a voltage difference between the upper and lower plates of the storage capacitor constant when a display panel is powered off.

In the pixel driving circuit of the present invention, the voltage regulator module includes a control thin film transistor, and the voltage regulator module is configured to turn off the control thin film transistor according to a control signal when the display panel is powered off, thereby keeping the voltage difference between the upper and lower plates of the liquid crystal capacitor constant and keeping the voltage difference between the upper and lower plates of the storage capacitor constant.

In the pixel driving circuit of the present invention, a period of the control signal is synchronized with a period of the scan signal.

In the pixel driving circuit of the present invention, during a power off period of the display panel, the scan signal and the control signal both change from a high electrical level to a low electrical level.

In the pixel driving circuit of the present invention, the voltage regulator module is further configured to control closing of the control thin film transistor according to the control signal when the display panel is operated, so as to provide a common voltage to the lower plate of the liquid crystal capacitor and the lower plate of the storage capacitor.

In the pixel driving circuit of the present invention, the voltage regulator module includes the control thin film transistor, and a gate of the control thin film transistor is connected to the control signal, a source of the control thin film transistor is connected to a common voltage, and a drain of the control thin film transistor is connected to the lower plate of the liquid crystal capacitor and the lower plate of the storage capacitor respectively.

In the pixel driving circuit of the present invention, the common voltage drops at a first moment, and the control signal changes from a high electrical level to a low electrical level at a second moment, and the first moment is earlier than the second moment.

In the pixel driving circuit of the present invention, the common voltage drops at a first moment, the control signal changes from a high electrical level to a low electrical level at a second moment, and the second moment is earlier than the first moment.

The present invention also provides a display panel, including: a driving thin film transistor, a liquid crystal capacitor, a storage capacitor, and a voltage regulator module, wherein a gate of the driving thin film transistor is connected to a scan signal, a source of the driving thin film transistor is connected to a data signal, and an upper plate of the liquid crystal capacitor and an upper plate of the storage capacitor are both connected to a drain of the driving thin film transistor, while a lower plate of the liquid crystal capacitor and a lower plate of the storage capacitor are both connected to the voltage regulator module, wherein the voltage regulator module configured to keep a voltage difference between the upper and lower plates of the liquid crystal capacitor constant and keep a voltage difference between the upper and lower plates of the storage capacitor constant when the display panel is powered off.

In the display panel of the present invention, the voltage regulator module includes a control thin film transistor, and the voltage regulator module is configured to turn off the control thin film transistor according to a control signal when the display panel is powered off, thereby keeping the voltage difference between the upper and lower plates of the liquid crystal capacitor and keeping the voltage difference between the upper and lower plates of the storage capacitor constant.

In the display panel of the present invention, a period of the control signal is synchronized with a period of the scan signal.

In the display panel of the present invention, during a power off period of the display panel, the scan signal and the control signal both change from a high electrical level to a low electrical level.

In the display panel of the present invention, the voltage regulator module is further configured to control a closing of the control thin film transistor according to the control signal when the display panel is operated, so as to provide a common voltage to the lower plate of the liquid crystal capacitor and the lower plate of the storage capacitor.

In the display panel of the present invention, the voltage regulator module includes the control thin film transistor, and a gate of the control thin film transistor is connected to the control signal, a source of the control thin film transistor is connected to a common voltage, and a drain of the control thin film transistor is connected to the lower plate of the liquid crystal capacitor and the lower plate of the storage capacitor respectively.

In the display panel of the present invention, the common voltage drops at a first moment, and the control signal changes from a high electrical level to a low electrical level at a second moment, and the first moment is earlier than the second moment.

In the display panel of the present invention, the common voltage drops at a first moment, the control signal changes from a high electrical level to a low electrical level at a second moment, and the second moment is earlier than the first moment.

The present invention further provides a display device, including the above-mentioned display panel.

In the pixel driving circuit, the display panel, and the display device of the present invention, the voltage difference between the two plates of the liquid crystal capacitor and the voltage difference between the two plates of the liquid crystal capacitor can be kept constant when the display panel is powered off by introducing a voltage regulator module to the conventional pixel driving circuit. The voltage difference between the two plates of the storage capacitor is kept constant, thereby preventing a display panel from the occurrence of a splash screen when the display panel is turned back on, thereby improving the display effect.

BRIEF DESCRIPTION OF THE SEVERAL VIEWS OF THE DRAWINGS

In order to more clearly illustrate the embodiments or the technical solutions of the existing art, the drawings illustrating the embodiments or the existing art will be briefly described below. Obviously, the drawings in the following description merely illustrate some embodiments of the present invention. Other drawings may also be obtained by those skilled in the art according to these figures without paying creative work.

DESCRIPTION OF SPECIFIC EMBODIMENTS OF THE INVENTION

The following description of the various embodiments is provided to illustrate the specific embodiments of the invention. The spatially relative directional terms mentioned in the present invention, such as "upper", "lower", "before", "after", "left", "right", "inside", "outside", "side", etc. and the like, may be used herein for ease of description to describe one element or feature's relationship to another element(s) or feature(s) as illustrated in the figures which are merely references. The spatially relative terms are intended to encompass different orientations in addition to the orientation as depicted in the figures.

Figure 1:
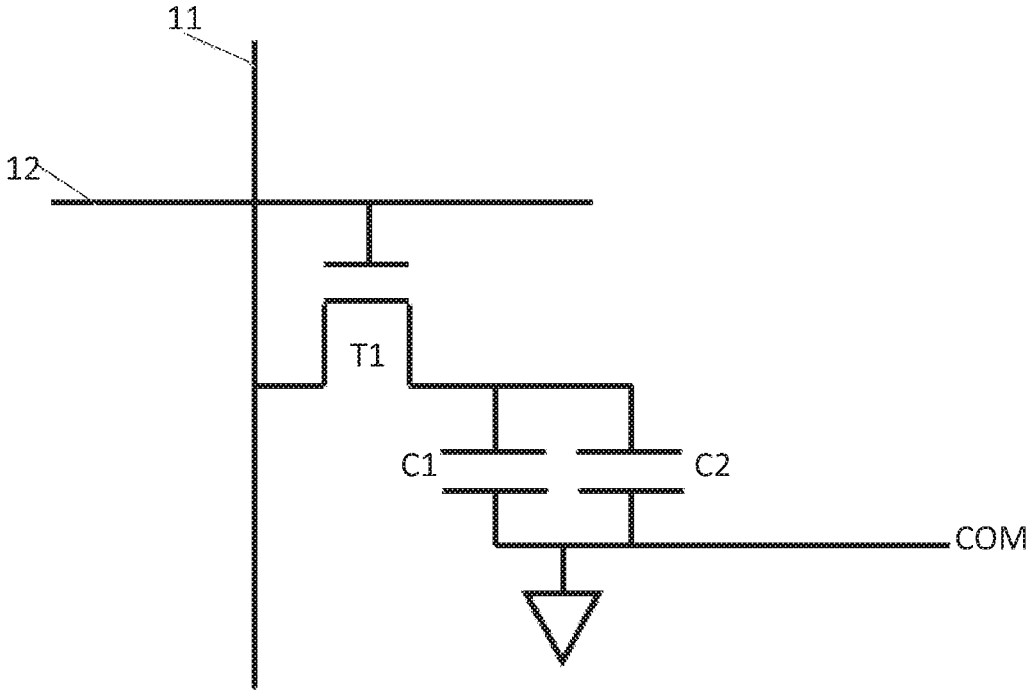
FIG. 1 is a schematic structural view of a conventional pixel driving circuit.
Figure 2:
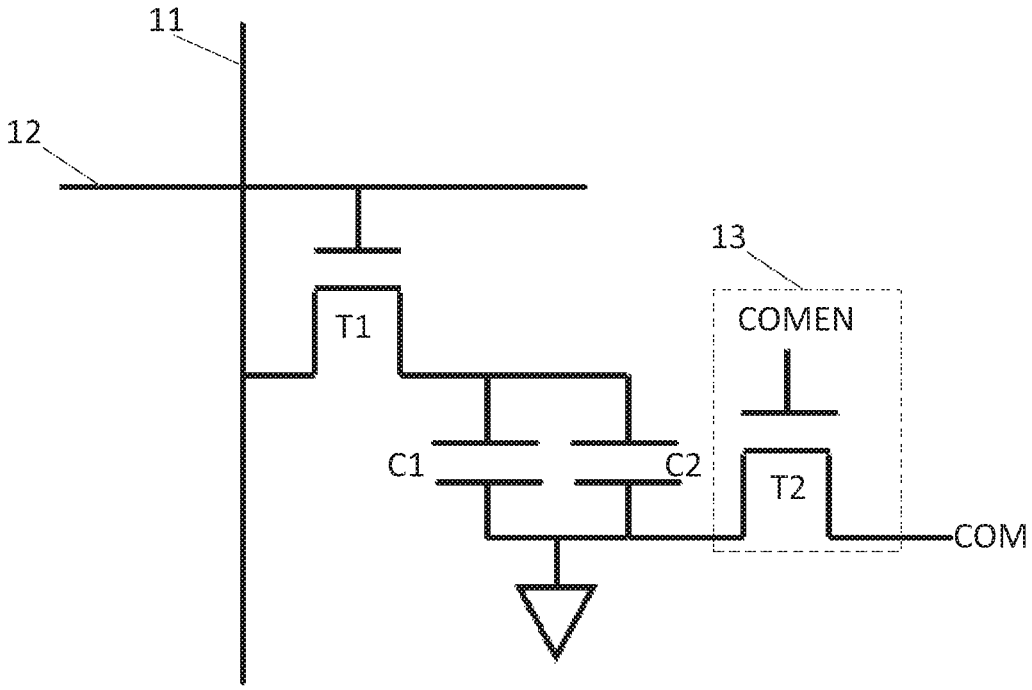
FIG. 2 is a schematic structural view of a pixel driving circuit of the present invention.

Please refer to FIG. 2. FIG. 2 is a schematic structural diagram of a pixel driving circuit of the present invention.

As shown in FIG. 2, the pixel driving circuit of the present invention includes a driving thin film transistor T1, a liquid crystal capacitor C1, a storage capacitor C2, and a voltage regulator module 13. The gate of the driving thin film transistor T1 is connected to the scan line 12, and the scan line 12 is input with the scan signal (gate). The source of the driving thin film transistor T1 is connected to the data line 11, and the data line 11 is input with the access data signal (data).

The upper plate of the liquid crystal capacitor C1 and the upper plate of the storage capacitor C2 are both connected to a drain of the driving thin film transistor T1, the lower plate of the liquid crystal capacitor C1 and the lower plate of the storage capacitor C2 are both connected to the voltage regulator module 13, which is configured to keep a voltage difference between the upper and lower plates of the liquid crystal capacitor C1 and the upper and lower plates of the storage capacitor C2 constant.

The voltage regulator module 13 includes a control thin film transistor T2, and the voltage regulator module 13 is configured to turn off the control thin film transistor T2 according to a control signal COMEN when the display panel is powered off, thereby keeping the voltage difference between the upper and lower plates of the liquid crystal capacitor C1 constant and keeping the voltage difference between the upper and lower plates of the storage capacitor C2 constant.

The voltage regulator module 13 is further configured to provide a common voltage COM to the lower plate of the liquid crystal capacitor C1 and the lower plate of the storage capacitor C2 during operation of the display panel. The voltage regulator module 13 is specifically configured to control closing of the control thin film transistor T2 according to the control signal COMEN during operation of the display panel, so as to provide the common voltage to the lower plate of the liquid crystal capacitor C1 and the lower plate of the storage capacitor C2.

The voltage regulator module 13 includes a control thin film transistor T2. The gate of the control thin film transistor T2 is connected to the control signal COMEN, and the source of the control thin film transistor T2 is connected to a common voltage (COM). The drain of the transistor T2 is connected to the lower plate of the liquid crystal capacitor C1 and the lower plate of the storage capacitor C2, respectively.

Figure 3:
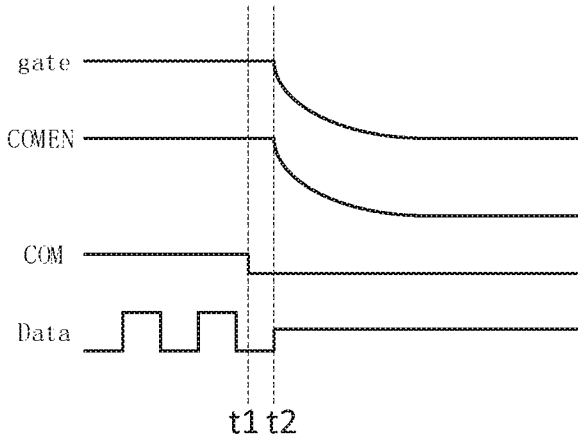
FIG. 3 is a first timing diagram of pixel driving circuit of the present invention.
Figure 4:
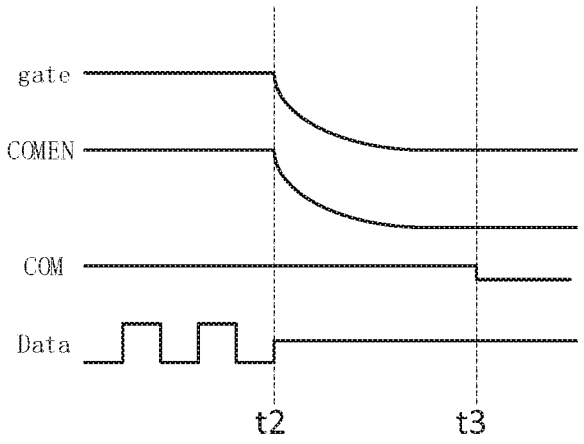
FIG. 4 is a second timing diagram of the pixel driving circuit of the present invention.

As shown in FIGS. 3 and 4, the period of the control signal COMEN is synchronized with the period of the scan signal (gate).

As shown in FIGS. 3 and 4, during power-off of the display panel, the scan signal (gate) and the control signal COMEN are both changed from a high electrical level to a low electrical level.

The scan signal (gate) and the control signal COMEN are both high electrical level during operation of the display panel.

In an embodiment, as shown in FIG. 3, the common voltage COM decreases at a first moment (t1), and the control signal COMEN changes from a high electrical level to a low electrical level at a second moment (t2), wherein the first moment is earlier than the second moment, that is, t1 is earlier than t2.

In another embodiment, as shown in FIG. 4, the common voltage COM decreases at a first moment (t3), and the control signal COMEN changes from a high electrical level to a low electrical level at a second moment (t2), wherein the first moment is later than the second moment, that is, t2 is earlier than t3. That is, the COM signal drops to the GND potential before the gate/COMEN signal falls or the COM signal drops to the GND potential after the gate/COMEN signal falls.

Since the scanning signal decreases when the display panel is powered off according to the present invention, thereby affecting the upper plate of the voltage of the liquid crystal capacitor and the upper plate of the storage capacitor, causing the voltage of the upper plate of the capacitor to shift. In the meantime, the control signal is also synchronously decreased, thereby affecting the lower plate of the voltage of the liquid crystal capacitor and the lower plate of the storage capacitor, so that the voltage of the lower plates exhibit the same shift as the upper plates. Since the voltages of the upper and lower plates are simultaneously shifted, the voltage difference between the upper and lower plates is kept constant, thereby avoiding the phenomenon of splash screen.

The present invention also provides a display panel including any of the above pixel driving circuits.

The present invention also provides a display device including the above display panel.

In the pixel driving circuit, the display panel, and the display device of the present invention, the voltage difference between the two plates of the liquid crystal capacitor and the voltage difference between the two plates of the liquid crystal capacitor can be kept constant when the display panel is powered off by introducing a voltage regulator module to the conventional pixel driving circuit. The voltage difference between the two plates of the storage capacitor is kept constant, thereby preventing a display panel from the occurrence of a splash screen when the display panel is turned back on, thereby improving the display effect.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A pixel driving circuit, comprising:

a driving thin film transistor;

a liquid crystal capacitor;

a storage capacitor; and a voltage regulator module, wherein a gate of the driving thin film transistor is connected to a scan signal, a source of the driving thin film transistor is connected to a data signal, and an upper plate of the liquid crystal capacitor and an upper plate of the storage capacitor are both connected to a drain of the driving thin film transistor, while a lower plate of the liquid crystal capacitor and a lower plate of the storage capacitor are both connected to the voltage regulator module, wherein the voltage regulator module is configured to keep a voltage difference between the upper and lower plates of the liquid crystal capacitor constant and keep a voltage difference between the upper and lower plates of the storage capacitor constant when a display panel is powered off.

2. The pixel driving circuit of claim 1, wherein the voltage regulator module comprises a control thin film transistor, and the voltage regulator module is configured to turn off the control thin film transistor according to a control signal when the display panel is powered off, thereby keeping the voltage difference between the upper and lower plates of the liquid crystal capacitor constant and keeping the voltage difference between the upper and lower plates of the storage capacitor constant.

3. The pixel driving circuit of claim 2, wherein a period of the control signal is synchronized with a period of the scan signal.

4. The pixel driving circuit of claim 3, wherein during a power off period of the display panel, the scan signal and the control signal both change from a high electrical level to a low electrical level.

5. The pixel driving circuit of claim 2, wherein the voltage regulator module is further configured to control closing of the control thin film transistor according to the control signal when the display panel is operated, so as to provide a common voltage to the lower plate of the liquid crystal capacitor and the lower plate of the storage capacitor.

6. The pixel driving circuit of claim 2, wherein the voltage regulator module comprises the control thin film transistor, and a gate of the control thin film transistor is connected to the control signal, a source of the control thin film transistor is connected to a common voltage, and a drain of the control thin film transistor is connected to the lower plate of the liquid crystal capacitor and the lower plate of the storage capacitor respectively.

7. The pixel driving circuit of claim 6, wherein the common voltage drops at a first moment, and the control signal changes from a high electrical level to a low electrical level at a second moment, and the first moment is earlier than the second moment.

8. The pixel driving circuit of claim 6, wherein the common voltage drops at a first moment, the control signal changes from a high electrical level to a low electrical level at a second moment, and the second moment is earlier than the first moment.

9. A display panel comprising a pixel driving circuit, comprising:

a driving thin film transistor, a liquid crystal capacitor, a storage capacitor, and a voltage regulator module, wherein a gate of the driving thin film transistor is connected to a scan signal, a source of the driving thin film transistor is connected to a data signal, and an upper plate of the liquid crystal capacitor and an upper plate of the storage capacitor are both connected to a drain of the driving thin film transistor, while a lower plate of the liquid crystal capacitor and a lower plate of the storage capacitor are both connected to the voltage regulator module, wherein the voltage regulator module configured to keep a voltage difference between the upper and lower plates of the liquid crystal capacitor constant and keep a voltage difference between the upper and lower plates of the storage capacitor constant when the display panel is powered off.

10. The display panel of claim 9, wherein the voltage regulator module comprises a control thin film transistor, and the voltage regulator module is configured to turn off the control thin film transistor according to a control signal when the display panel is powered off, thereby keeping the voltage difference between the upper and lower plates of the liquid crystal capacitor and keeping the voltage difference between the upper and lower plates of the storage capacitor constant.

11. The display panel of claim 10, wherein a period of the control signal is synchronized with a period of the scan signal.

12. The display panel of claim 11 wherein during a power off period of the display panel, the scan signal and the control signal both change from a high electrical level to a low electrical level.

13. The display panel of claim 10, wherein the voltage regulator module is further configured to control a closing of the control thin film transistor according to the control signal when the display panel is operated, so as to provide a common voltage to the lower plate of the liquid crystal capacitor and the lower plate of the storage capacitor.

14. The display panel of claim 10, wherein the voltage regulator module comprises the control thin film transistor, and a gate of the control thin film transistor is connected to the control signal, a source of the control thin film transistor is connected to a common voltage, and a drain of the control thin film transistor is connected to the lower plate of the liquid crystal capacitor and the lower plate of the storage capacitor respectively.

15. The display panel of claim 14, wherein the common voltage drops at a first moment, and the control signal changes from a high electrical level to a low electrical level at a second moment, and the first moment is earlier than the second moment.

16. The display panel of claim 14, wherein the common voltage drops at a first moment, the control signal changes from a high electrical level to a low electrical level at a second moment, and the second moment is earlier than the first moment.

17. A display device comprising a display panel comprising a pixel driving circuit, comprising:

a driving thin film transistor, a liquid crystal capacitor, a storage capacitor, and a voltage regulator module, wherein a gate of the driving thin film transistor is connected to a scan signal, a source of the driving thin film transistor is connected to a data signal, and an upper plate of the liquid crystal capacitor and an upper plate of the storage capacitor are both connected to a drain of the driving thin film transistor, while a lower plate of the liquid crystal capacitor and a lower plate of the storage capacitor are both connected to the voltage regulator module, wherein the voltage regulator module configured to keep a voltage difference between the upper and lower plates of the liquid crystal capacitor constant and keep a voltage difference between the upper and lower plates of the storage capacitor constant when the display panel is powered off.

18. The display device of claim 17, wherein the voltage regulator module comprises a control thin film transistor, and the voltage regulator module is configured to turn off the control thin film transistor according to a control signal when the display panel is powered off, thereby keeping the voltage difference between the upper and lower plates of the liquid crystal capacitor and keeping the voltage difference between the upper and lower plates of the storage capacitor constant.

19. The display device of claim 18, wherein a period of the control signal is synchronized with a period of the scan signal.

20. The display device of claim 19, wherein during a power off period of the display panel, the scan signal and the control signal both change from a high electrical level to a low electrical level.

* * * * *